United States Patent [19]

Labie et al.

[11] 4,030,257

[45] June 21, 1977

[54] FOLDED SLAB FLOOR CONSTRUCTION AND METHOD

[75] Inventors: Allan S. Labie, New York; Charles Thornton, Pleasantville; Irwin Paul Lew, Forest Hills; Abraham Gutman, Old Bethpage, all of N.Y.

[73] Assignee: International Environmental Dynamics, New York, N.Y.

[22] Filed: Mar. 4, 1975

[21] Appl. No.: 555,329

[52] U.S. Cl. ..... 52/126; 52/73; 52/227; 52/236.5; 52/259; 52/600; 52/744; 52/745

[51] Int. Cl.[2] ..... E04B 1/35; E04B 1/34

[58] Field of Search ..... 52/234, 258, 236, 254, 52/73, 255, 126, 256, 226, 257, 227, 378, 235, 379, 259, 744, 745, 447, 747, 332, 444, 324, 450, 250, 453, 229, 414, 629, 600

[56] References Cited

UNITED STATES PATENTS

| | | | |
|---|---|---|---|
| 2,116,886 | 5/1938 | Goetz | 52/367 X |
| 2,645,115 | 7/1953 | Abeles | 52/229 |
| 3,017,723 | 1/1962 | Von Heidenstam | 52/236 |
| 3,036,816 | 5/1962 | Stubbs et al. | 52/126 X |
| 3,245,186 | 4/1966 | Jentoft | 52/450 X |
| 3,248,836 | 5/1966 | Monk et al. | 52/600 X |
| 3,254,466 | 6/1966 | Von Heidenstam | 52/236 |
| 3,279,142 | 10/1966 | Entwistle | 52/236 X |
| 3,543,458 | 12/1970 | Guritz | 52/744 X |
| 3,748,796 | 7/1973 | Ouellet | 52/86 |
| 3,822,522 | 7/1974 | Termohlen et al. | 52/126 X |

FOREIGN PATENTS OR APPLICATIONS

| | | | |
|---|---|---|---|
| 152,872 | 4/1938 | Austria | 52/450 |
| 2,172,890 | 10/1973 | France | 52/630 |
| 916,630 | 2/1946 | France | 52/234 |
| 1,072,620 | 9/1954 | France | 52/433 |
| 362,920 | 7/1906 | France | 52/440 |
| 1,168,156 | 12/1958 | France | 52/126 |
| 1,381,123 | 10/1964 | France | 52/126 |
| 810,077 | 8/1951 | Germany | 52/600 |
| 1,409,923 | 5/1969 | Germany | 52/236 |
| 805,706 | 5/1951 | Germany | 52/444 |
| 506,370 | 12/1954 | Italy | 52/229 |
| 584,062 | 10/1958 | Italy | 52/324 |
| 441,740 | 11/1948 | Italy | 52/259 |
| 361,384 | 5/1962 | Switzerland | 52/332 |

*Primary Examiner*—Leslie Braun
*Attorney, Agent, or Firm*—Townsend and Townsend

[57] ABSTRACT

A reinforced concrete floor is constructed from a continuous slab defining a major and planar supporting surface. The continuous slab is folded at at least one beam defining path across its planar supporting surface and preferably includes a right angle grid of such folds with downward peripheral folds at the slab edges and downward V-sectioned folds to interrupt the major and planar supporting surface. By maintaining a constant vertical slab thickness and keeping the angle of the folds between 30° and 60° with respect to the major supporting surface, it is possible to nest and even construct a continuous stack of floors having identical overlying structural members and dimensions, such as the structurally and dimensionally repetitive overlying floors of a high-rise building. Moreover, when a nested stack of such floors is constructed or placed, the top floor of each nest in sequence at its beam defining folds can have beams placed immediately prior to lifting, while underlying floors await exposure to the top of the nest and placement of their beams in turn. Preferably, either cast-in-place or precast beams are placed from above the exposed floor into and fastened along the folds. This simultaneously completes the flat supporting surface of the floor as well as provides any needed and additional structural rigidity in the plane of the floor. Where the floors are nested at the base of a building vertical structural member, which can preferably be one or more central supporting towers, a building process results. Floors formed of folded, nested and stacked slabs are in sequence commencing with the top building floor and ending with the bottom building floor completed. Completion occurs by the placement of beams and/or flooring and sequentially raising and supporting each floor from the vertical structural member to provide a high-rise building.

28 Claims, 14 Drawing Figures

FOLDED SLAB FLOOR CONSTRUCTION AND METHOD

This invention relates to the constuction of reinforced concrete building floors. More particularly, this invention relates to the construction of a reinforced concrete floor which is constructed on the ground and raised about and supported from a vertical structural member such as a central, hollow core tower.

SUMMARY OF THE PRIOR ART

It is already known to construct floors at ground level about a vertical structural member such as a central supporting tower and to raise and support the floors from a tower. These floors must be provided with lateral and longitudinal beams to provide lateral and longitudinal stiffness, rigidity and support.

Such beams have heretofore constituted an irregularity in the thickness of the floor. Thus, floors constructed at the base of a building are typically constructed one at a time. Typically, the longitudinally and lateral beams are first layed. These beams are made of steel or concrete. Thereafter, the floor is constructed on top of the beam and subsequently raised and fastened to the vertical structural member, such as a central supporting tower.

It has been heretofore suggested that floors may be most economically constructed by being fabricated in a stack one on top of another. Unfortunately, the beams required in such flooring have heretofore constituted a serious obstacle. These beams constitute the thickest section of the floor. Sections of the floor peripheral to the beams must be blocked out when concrete floors are poured and cured one upon another. The simple process of blocking out the floor to accommodate its relatively smaller section peripheral to the beams consumes time, adds cost and frequently provides a completed stack of floors of such height that much economy is lost. Moreover, form work for underlying floors cannot be repetitively used on overlying floors.

SUMMARY OF THE INVENTION

A reinforced concrete floor is constructed from a continuous slab defining a major and planar supporting surface. The continuous slab is folded at at least one beam defining path across its planar supporting surface and preferably includes a right angle grid of such folds with downward peripheral folds at the slab edges and downward V-sectioned folds to interrupt the major and planar supporting surface. By maintaining a constant vertical slab thickness and keeping the angle of the folds between 30° and 60° with respect to the major supporting surface, it is possible to nest and even construct a continuous stack of floors having identical overlying structural members and dimensions, such as the structurally and dimensionally repetitive overlying floors of a high-rise building. Moreover, when a nested stack of such floors is constructed or placed, the top floor of each nest in sequence at its beam defining folds can have beams placed immediately prior to lifting, while underlying floors await exposure to the top of the nest and placement of their beams in turn. Preferably, either cast-in-place or precast beams are placed from above the exposed floor into and fastened along the folds. This simultaneously completes the flat supporting surface of the floor as well as provides any needed and additional structural rigidity in the plane of the floor. Where the floors are nested at the base of a building vertical structural member, which can preferably be one or more central supporting towers, a building process results. Floors formed of folded nested and stacked slabs are in sequence commencing with the top building floor and ending with the bottom building floor completed. Completion occurs by the placement of beams and/or flooring and sequentially raising and supporting each floor from the vertical structural member to provide a high-rise building.

OBJECTS AND ADVANTAGES OF THE INVENTION

An object of this invention is to disclose a floor which can be built in nested relation. According to this aspect of the invention, building floors having identical overlying structural members and dimensions are built one on top of another. Folds in the floor are formed along identical overlying structural paths to provide for beam stiffening and strengthening of the floor. The folds are provided at an angle which is preferably in the range of 30° to 60°. By providing a constant vertical dimension, the floors may be constructed with the underlying floor utilized to the maximum possible extent as the support for the form of an overlying floor.

An advantage of this aspect of the invention is that for the first time structurally complete floors can be built around the base of a tower in a nest without the necessity of blocked areas at the interface of floors in the nest. Difficulties inherent in the forming of beams integral with the floor, the blocking out of floor areas in between the beams, and the like are avoided to the maximum possible extent.

A further advantage of this invention is that the uppermost floor can have its respective beam defining folds receive subsequently placed beams. Such beams can be of the precast or cast-in-place variety. Thus, the uppermost floor only need have placed therein its floor stiffening beams.

A further advantage of this invention is that where cast-in-place concrete beams are used with floors of this invention, complete curing of such beams does not have to occur before the floors are raised. Rather, the beams can be cured only to the point where they provide adequate structural stiffness for anticipated loadings, either dynamic or static, during lifting the floor to the erected position. When the floor is fastened to the tower, complete curing with complete structural strength can subsequently occur.

An abject of this invention is to provide a beam in a reinforced concrete floor by the expedient of folding the floor. According to this aspect of the invention, the floor having a planar major supporting surface includes an upwardly concave fold along at least one beam defining path across its planar supporting surface. The floor proximate the beam fold provides one flange member of the beam. The fold, at its point remote from the major supporting surface of the beam, provides the remaining flange member of the beam. A beam stiffening the floor results from the fold.

An advantage of this aspect of the invention is that by the placement of the fold in the floor, beams in the floor can be eliminated altogether.

A further object of this invention is to disclose a beam shape which can extend across and interrupt the major planar supporting surface of the floor. According to this aspect of the invention, a V-shaped fold is placed in the floor. Preferably the V is truncated by a small slab parallel to and below the major supporting slab of the floor.

Another object of this invention is to disclose a floor fold at the periphery of the floor which defines a beam. According to this aspect of the invention, the floor is provided with a downwardly folded angle at the periphery. This fold is provided with a small supporting margin parallel to and below the major supporting slab of the floor.

An advantage of the folded floor of this invention is that either the folds alone can form the floor stiffening beam or alternately the fold can form an upwardly exposed concavity to receive either precast or cast-in-place beams.

A further object of this invention is to disclose a floor folding pattern which provides optimum floor support. According to this aspect of the invention, each floor is provided with a central longitudinal V-shaped fold with peripheral down angle folds surrounding its edges. Transverse folds adjoining the tower are provided. The result is a right angle grid of floor supporting beams which provides structural rigidity.

An advantage of this aspect of the invention is that the longitudinal beam underlie a central hallway.

A further advantage of this aspect of the invention is that the beams can be conveniently placed for attachment to the building.

Yet another object of this invention is to disclose a new process for the construction of the building. A tower is first constructed. Thereafter, folded floors with repetitively overlying beams are poured and cured in nested relation with the bottommost floor being poured and cured first, and the topmost floor being poured and cured last. Thereafter, each floor commencing with the top floor has beams placed in its upwardly exposed folds. These beams complete the structural rigidity of the floor. Simultaneously, these beams fill out the interruptions in the planar surface of the floor at the folds. As each floor at the top of the nest has its beams placed, it is thereafter hoisted and attached to the tower.

Other objects, features and advantages of this invention will become more apparent after referring to the following specification and attached drawings in which.

DESCRIPTION OF THE PREFERRED EMBODIMENT

Figure 1:
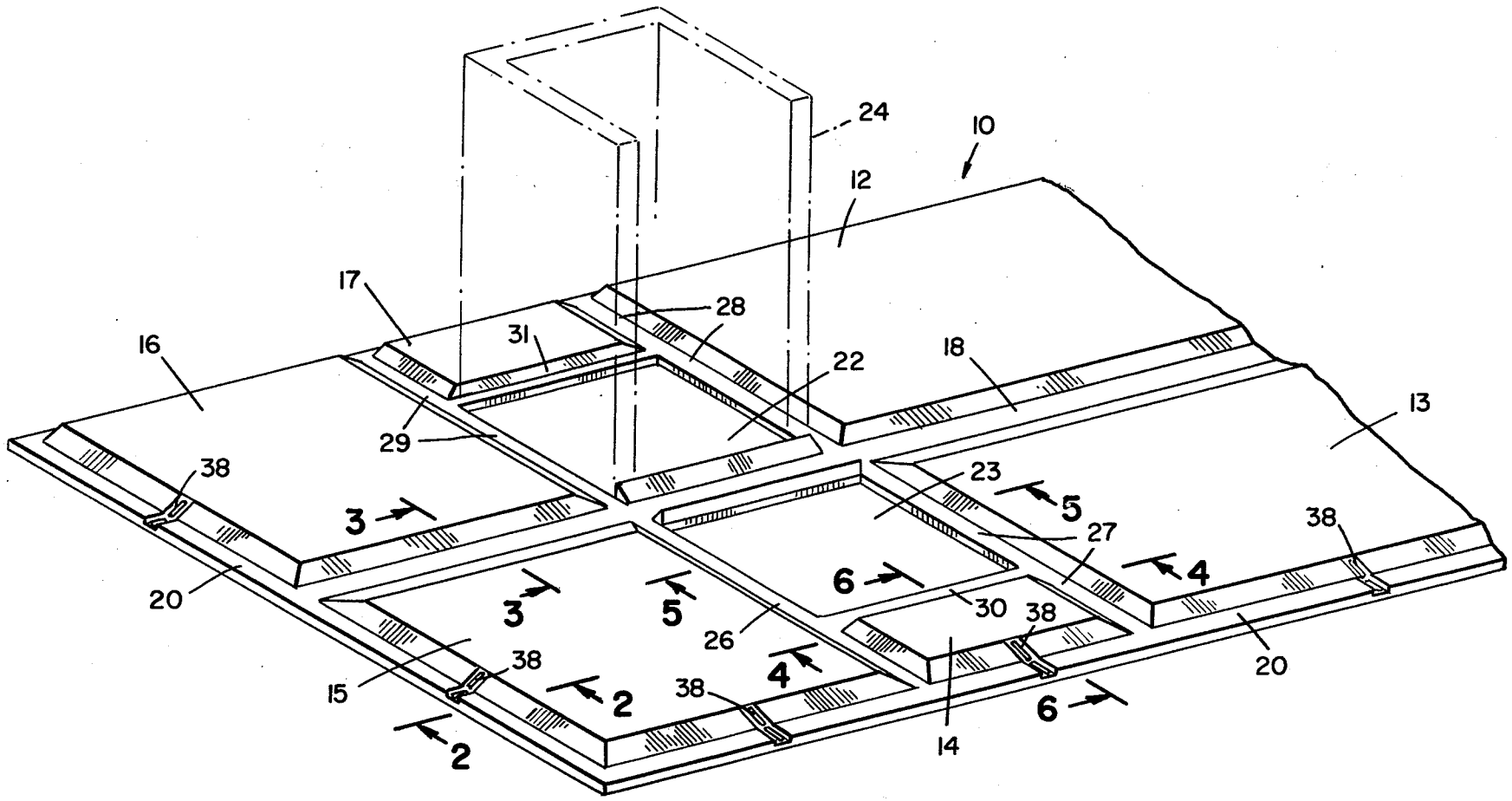
FIG. 1 is a perspective view of a portion of the floor slab of the present invention.

The preferred embodiment of the floor slab construction of the present invention is illustrated by way of reference to FIG. 1 wherein one half of a single floor slab 10 is the remaining half being symmetrically and repeatively formed to the broken section at the right of the drawing. Floor slab 10 comprises a unitary slab of poured reinforced concrete material. The preferred embodiment is described in relation to a floor slab 10 which is formed at the base of a core tower such as 24 and thereafter hoisted to a preselected elevated position and fastened to the core tower, as described in more detail hereinafter. However, it will be understood that the present invention can be applied to other construction techniques as well.

Floor slab 10 has a plurality of major planar portions 12–17 separated by a central fold 18 and a plurality of transverse folds 26–29. The upper surfaces of planar portions 12–17 are coplanar to define a major floor supporting surface. Folds 18 and 26–29 provide a stiffness to the floor slab, and also provide beam paths in which stiffening beams can be inserted, as illustrated in detail hereinafter.

Figure 3:
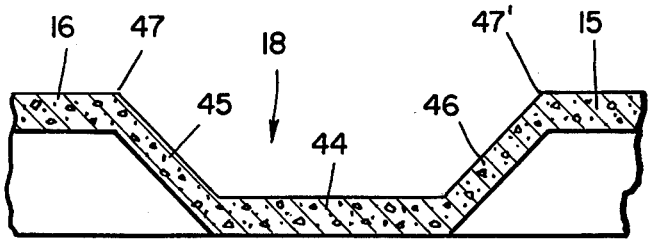

The manner in which the central fold 18 provides stiffness to floor slab 10 is illustrated by way of reference to FIGS. 1 and 3 in combination. Floor slab 18 has a truncated V-section which includes a depressed planar portion 44 and a pair of inclined portions 45, 46. The upper extremities 47, 47′ of the inclined portions 45, 46 of fold 18 are joined to major planar portions 15, 16 so that the fold provides an upwardly opening concavity.

It is apparent from viewing FIGS. 1 and 3 in combination that fold 18 acts as a beam to provide static resistance to bending. Specifically, depressed planar portion 44 acts as the lower flange of a beam. Major planar portions 15, 16 adjacent fold 18 act as the upper flanges of the beam. Inclined portions 45, 46 act as shear members connecting upper and lower flanges, and the fold thus provides stiffness to the floor slab. Thus, the fold plate construction defining an essentially upwardly concave interruption to the major supporting surface forms through its integrally connected portions a beam from the folded slab.

Central beam 18 provides stiffness to floor slab 20 in a single dimension. In order to provide lateral stiffness to floor slab 10, transverse folds 26–29 are formed in floor slab 10. Central fold 18 and transverse folds 26–29 provide a right angle grid of stiffening beams to provide two-dimensional stiffness to the floor slab.

Figure 4:
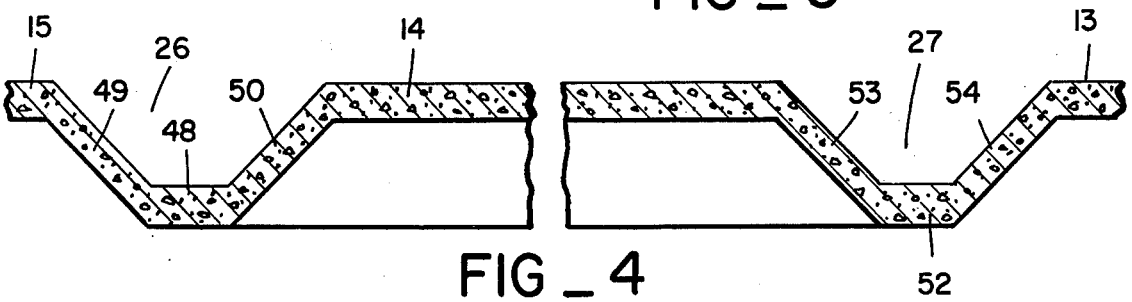

Referring to FIG. 4, in which transverse folds 26 and 27 are illustrated in detail, it is apparent that the transverse folds are formed similarly to central fold 18. Specifically, transverse fold 26 includes a depressed planar portion 48 having inclined side portions 49, 50 joined to major planar portions 14 and 15. Similarly, transverse fold 27 has a depressed planar portion 52 joined to major planar portions 13, 14 by inclined side portions 53, 54. The depressed planar portions 48, 52 act as lower flange members of a beam, and the major planar portions adjacent the fold act as an upper flange, providing stiffness to the floor slab.

Figure 2:
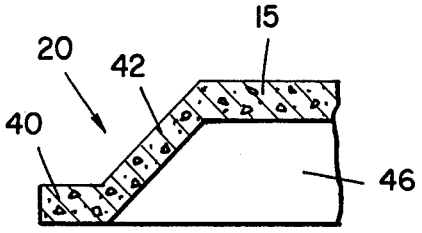
FIG. 2–6 are sectional views taken along lines 2—2 through 6—6, respectively, of FIG. 1.

In addition to the right angle grid of folds 18 and 26–29, floor slab 10 is provided with a depressed border 20. As illustrated in more detail in FIG. 2, the depressed border 20 of the floor slab has a depressed planar portion 40 and a single inclined portion 42 joining the depressed planar portion to the major planar portion such as 15 of the floor slab. Depressed border 20 also acts as a beam stiffener to the floor slab. The depressed planar portion 40 acts as the lower flange of a beam, and the major planar portion such as 15 adjacent border 20 acts as an upper flange to provide static resistance to bending. Hence, floor slab 10 is stiffened not only by folds 18 and 26–29, but by the depressed border 20 as well.

It will be apparent that two procedures can be followed with respect to a floor slab once it is formed. First, the floor can be completed over the top of the upwardly concave floors and the floors hoisted and fastened to the building. Where this occurs, the points of intersection of the folds in a right angle grid of folds must be reinforced across each intersection. This reinforcement across each intersection, typically by reinforcing bar is to prevent interruption of the upper flange and shear members of the folds. Moreover, it is desirable to tie the adjacent major slab surfaces on either side of the folds — again with the use of reinforcing bar. This prevents the folds, when under beam loading, from tending to open, separate further the joined major slab portions with resultant failure.

Secondly and preferably, beams can be placed and fastened in the upwardly exposed concavities of the folds. Where this beam placement occurs, multiple advantages result. First the floors are stiffened and reinforced along the path of the beams. Second, the floor is reinforced at the intersection of the folds. Third, adjoining major slab portions can be tied — one to another across the folds — to prevent the folds from opening. Finally, the major planar supporting surface of the floor can be completed by filling the upwardly exposed concavity created by the floor reinforcing folds. This second preferred method and embodiment of this invention is described hereafter.

Figure 5:
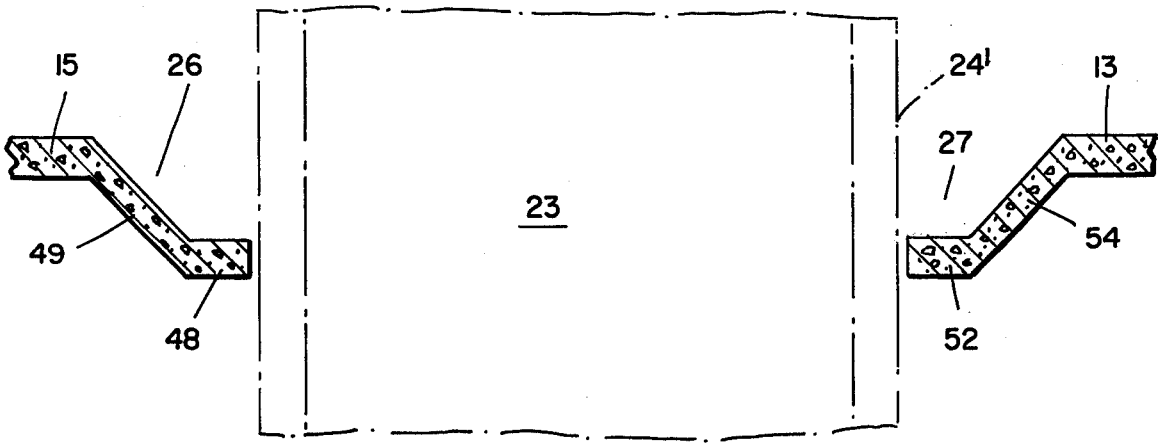

The preferred embodiment 10 of the floor slab as illustrated in FIG. 1 is adapted to be poured in place at the base of a core tower 24. Subsequently, the floors are to be supported from the tower. Accordingly, cutouts 22, 23 are provided in floor slab 10 so that the floor slab circumscribes the core tower. As is apparent from viewing FIGS. 1, 4 and 5 in combination, one of the inclined portions 50 of fold 26 terminates at cutout 23. Similarly, one inclined portion 53 of fold 27 terminates at the cutout portion 22. As a result, folds 26, 27 provide a depressed interior border adjacent core tower section 24'. This depressed interior border acts similarly to the outer border 20 of the floor slab to provide stiffness to the slab.

Figure 6:
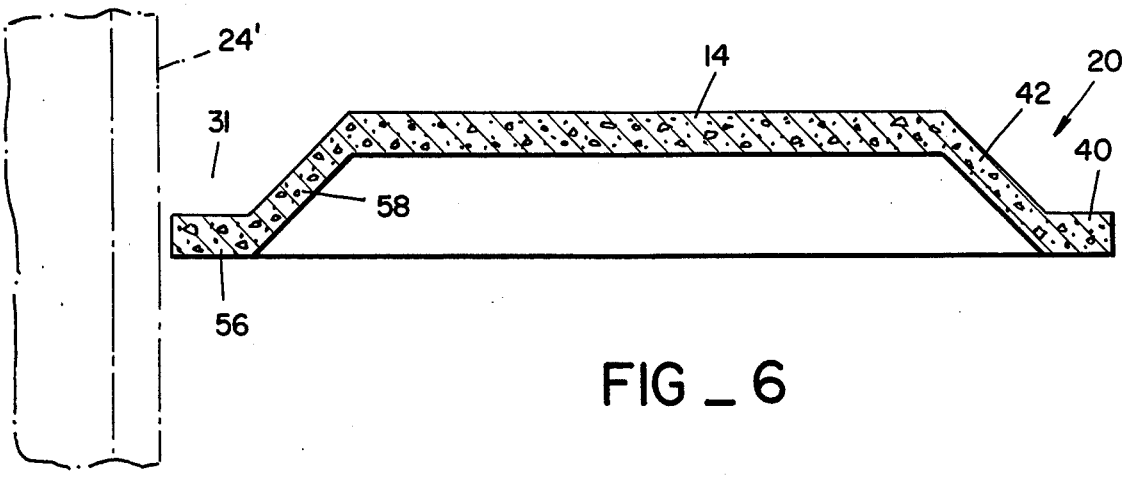

Referring to FIGS. 1 and 6 in combination, depressed interior borders 30, 31 are provided along the outer edges of cutouts 22, 23 in the floor slab. For example, depressed inner border 31 includes a depressed planar portion 56 and an inclined portion 58 joining the depressed planar portion to major planar portion 14. This depressed inner border also acts to stiffen floor slab 10 as described hereinabove.

The floor construction apparatus and method of this invention can be used with any configuration of vertical structural members useful for the support of a floor. For example, the floors can be fastened to depending vertical structural members all supported from the top of a tower as illustrated in Erbil U.S. Pat. No. 3,686,816. Such vertical structural members naturally would be under tension. Alternately, the floors could be supported from a plurality of conventional building columns. Such vertical structural members would be under compression.

The preferred embodiment of the present invention relates to a construction technique wherein the floor slab is poured in place at the base of a core tower, and thereafter hoisted to its preselected elevated position and attached to the core tower. In practice, it is possible to form a single floor slab at the base of the tower, allow it to cure, and hoist that floor slab into position before forming a second floor slab at the base of the tower. However, in the preferred construction process of the present invention, a plurality of floor slabs 60–63 are formed one on top of the other at the base of the core tower before any one of the floor slabs is hoisted into position, as illustrated in FIG. 7.

Figure 7:
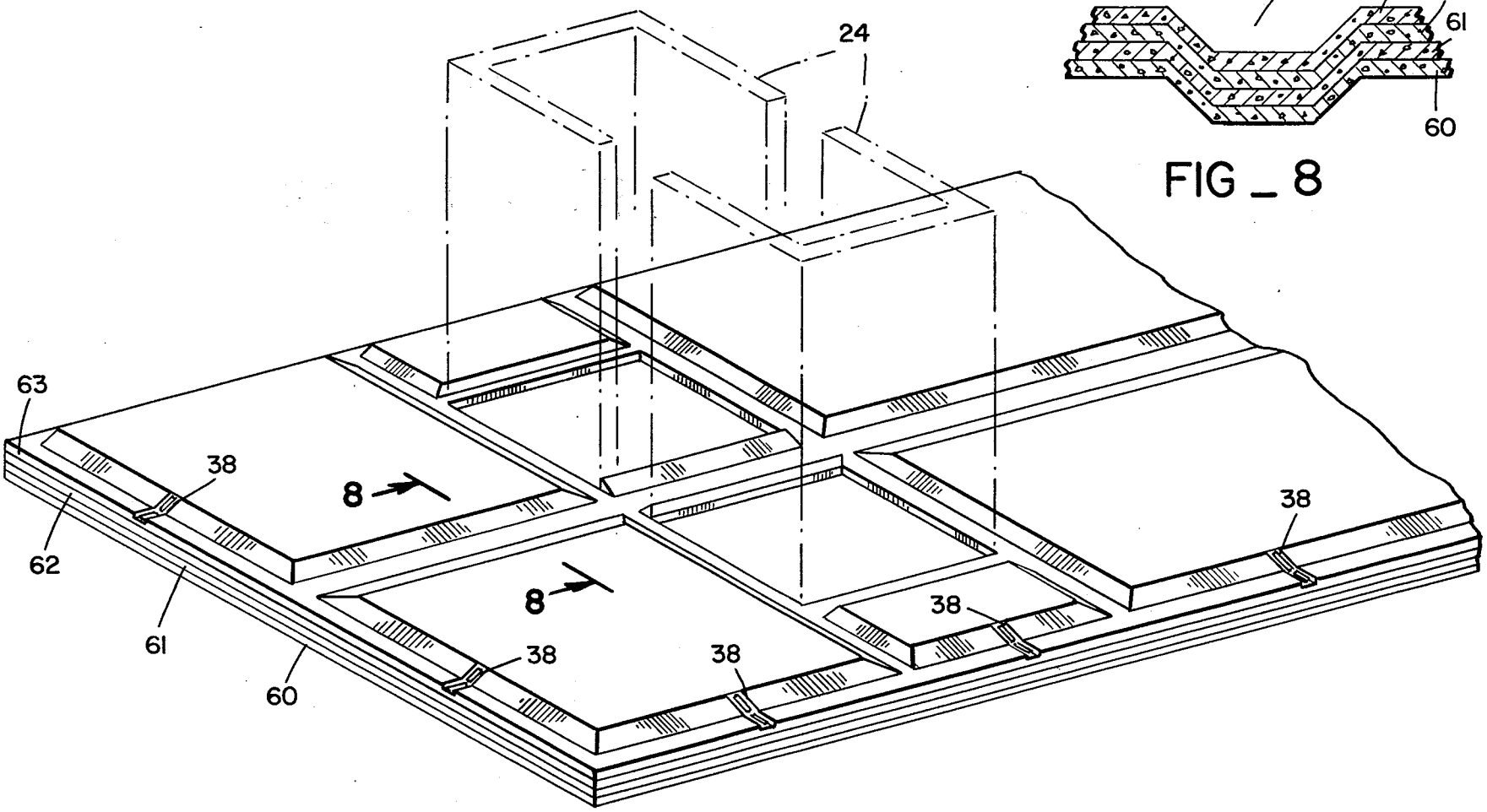
FIG. 7 is a perspective view of a plurality of poured and nested floor slabs formed at the base of a hollow core tower.

When several floor slabs are formed one on top of each other as illustrated in FIG. 7, it is desirable that the floors "nest", i.e., that the upper surface of each floor slab conform exactly to the lower surface of the overlying floor slab without any intervening gaps or spaces between the slabs. In order for such nesting to occur, it is essential that the vertical thickness, i.e., the vertical dimension of the floor slab in vertical section, be constant, not only along the planar portions of the floor slab but in the inclined portions of the fold as well. The nesting of floor slabs 60–63 at the central folds 18 which results from maintaining a constant vertical thickness throughout the slabs is illustrated in FIG. 8.

Figure 8:
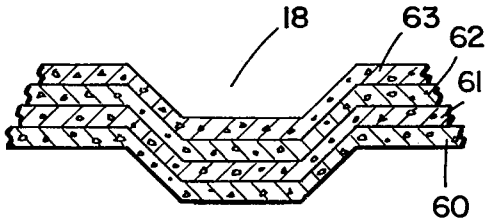
FIG. 8 is a sectional view taken along lines 8—8 of FIG. 7.

The principle advantage of having the floors nest as illustrated in FIGS. 7 and 8 is that floor slab will provide the basic form into which the next overlying floor slab can be poured. In order to pour the lowest floor slab 60, the ground surrounding core tower 24 can be graded to the desired shape of the floor slab, or forms can be constructed. After floor slab 60 has been poured and cured, it can be coated or covered with a uniform concrete release coating to provide the basic form for floor slab 61. Floor slab 61 can then be poured, and after it is cured, it will provide the basic form for floor slab 62. The process is repeated until the desired number of floor slabs have been constructed. A minimum of forming structure is required for the pouring of the floor slabs after the first floor slab has been poured and cured greatly reducing the time and expense in forming the floor slabs.

In order that the various folds and depressed portions of the floor slab provide stiffness to the slab, the floor slab must have significant depth so that the depressed planar portion is spaced a significant distance from the major planar portions. To this end, it is desirable that the angle which the inclined portions of the fold make with the major floor supporting surface be as large as possible. However, as this angle increases, the true thickness of the inclined portions of the fold decrease with the cosine of the fold angle. In order to obtain sufficient depth but still retain adequate thickness at the inclined portions of the folds, a fold angle of 45° has been found acceptable. However, it is anticipated that this fold angle could vary from a low of 30° to a high of 60° while still achieving the objects of the present invention.

Figure 9:
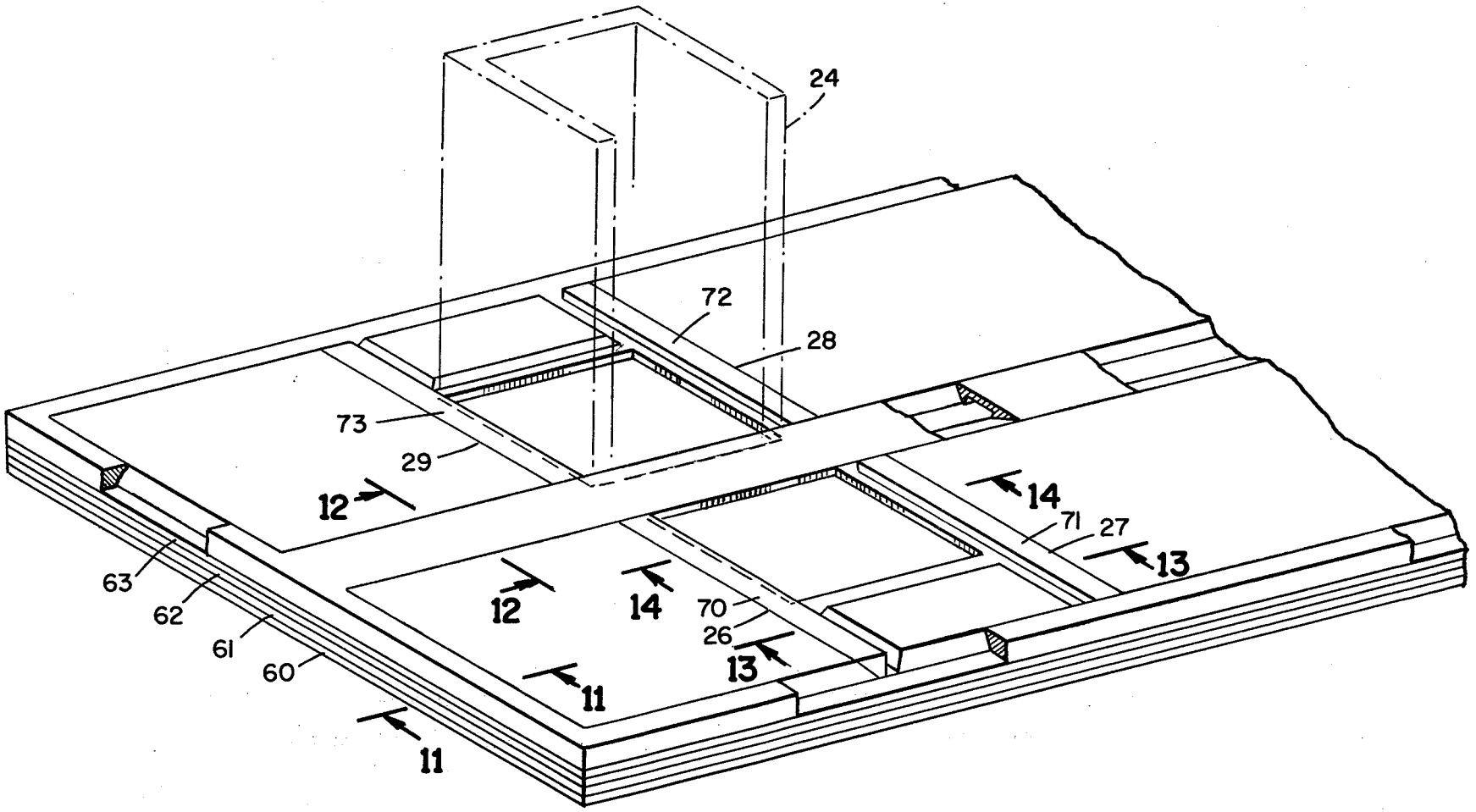
FIG. 9 is a perspective view of the plurality of poured and nested floors showing emplacement of the beam stiffeners with portions of the beam stiffeners broken away.

After the desired number of floor slabs have been constructed at the base of the core tower, the folds in the floor slabs are sequentially filled with beam stiffeners to strengthen and stiffen the floor slabs. As illustrated in FIG. 9, wherein the same reference numerals are used to identify floor slab features set forth earlier, beam stiffeners are first added to the uppermost floor slab 63 before it is histed to its preselected elevated position on tower 24. First, precast concrete beams 70–73 are placed in the respective transverse folds 26–29 (see also FIGS. 13 and 14). Precast beam 70 is conformed to the upper surface of the inclined portion 49 and partially spans depressed planar portion 48. Similarly, precast beam 71 is conformed to the upper surface of the inclined portion 54 of fold 27 and partially spans planar portion 52 thereof. After precast beams 70–73 are in place, reinforced concrete is poured in place in the remaining folds in uppermost slab 63, including the unfilled portions of transverse folds 26–29. (See FIG. 9.)

Figure 10:
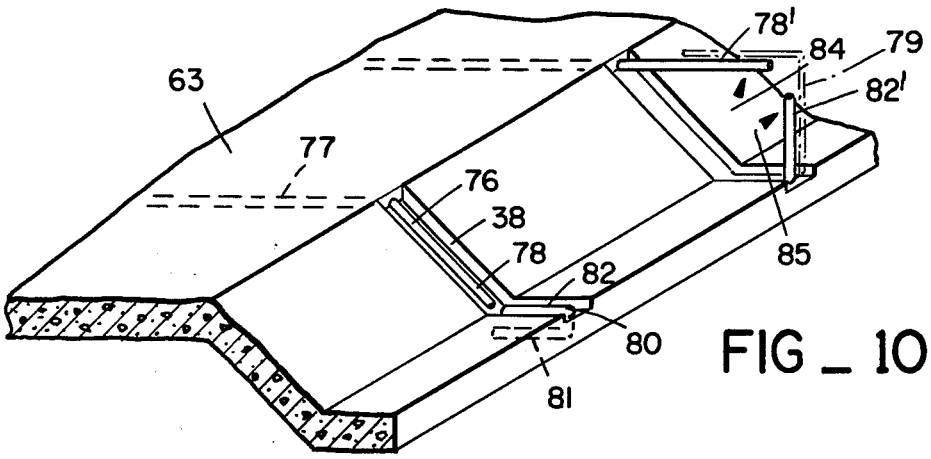
FIG. 10 is a fragmentary perspective view of a portion of the border of a floor slab illustrating the pull out dowels; and, FIGS. 11–14 are sectional views taken along lines 11—11 through 14—14, respectively, of FIG. 9.

The manner in which the poured in place concrete material is fastened to the already cured floor slab such as 63 is illustrated in FIG. 10. A reinforcing rod such as 76 has one end 77 embedded in floor slab 63 and a second end 78 folded downwardly in slot 38. In addition, a second dowel 80 has a portion 81 embedded in floor slab 63 and another portion 82 folded and placed within slot 38. Dowels 76, 80 must be folded in order that new floor slabs can be poured in place overlying previous floor slabs. However, after all of the floor slabs have been poured, the folded portions 78, 82 of the dowels and the uppermost slab can be folded outwardly as illustrated by arrows 84, 85 to the positions 78′, 82′ illustrated in FIG. 10. A closing bar 79 is typically placed between the dowels. In this configuration, the dowels will extend into the poured-in-place concrete and provide reinforcing bars to fasten the poured-in-place concrete to the already cured floor slab 63.

Figure 11:
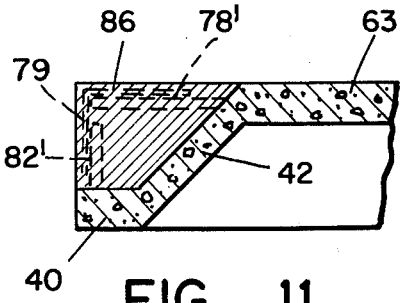

As illustrated in FIG. 11, the unfolded portions 78′, 82′ of the dowels extend into the poured-in-place concrete material 86 at the border of slab 63. As discussed previously, the border of the floor slab includes a depressed planar portion 40 and an inclined portion 42. The concrete is poured to the depression to a level matching the upper surface of floor slab 63, covering the exposed unfolded ends 78′, 82′ of the dowels. When in place, concrete 86 provides a stiffening beam at the border of the floor slab.

It will be appreciated that all the folds in each floor slab can contain pockets and dowels similar to those shown in FIG. 10. When these dowels are bent out and concrete poured and cured in the resulting upwardly concave folds, several major advantages will follow.

First, subsequently poured and cured cast-in-place beams will be integrally tied to upwardly concave folds. Secondly, the cast-in-place beam will be provided with a shear key to the underlying upwardly concave folded plate. Third, adjacent major planar portions of the slabs on either side of the folds can be tied one to another by conventional closing bars. An integral structural tie between floor slab and subsequently placed beam results.

Figure 12:
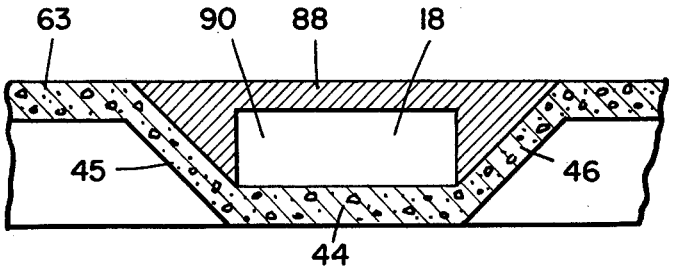

The poured-in-place concrete material 88 in center fold 18 is illustrated by way of reference to FIG. 12. Concrete material 88 conforms to the inclined portions 45, 46 of floor slab 63, but a void 90 is provided overlying depressed planar portion 44. Void 90 minimizes the weight of the beam formed by poured-in-place concrete 88 together with fold 18 without significantly sacrificing the beam stiffening and strengthening obtained thereby.

Figure 13:
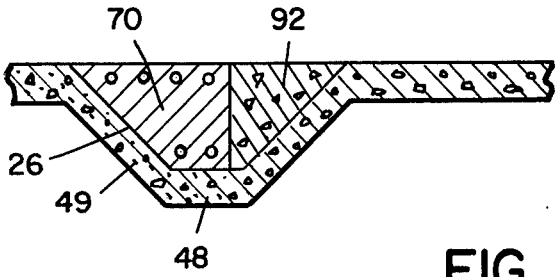
Figure 13:
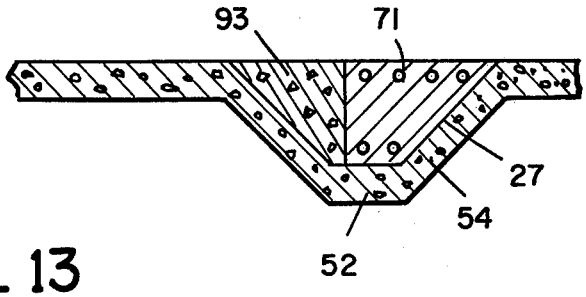
Figure 14:
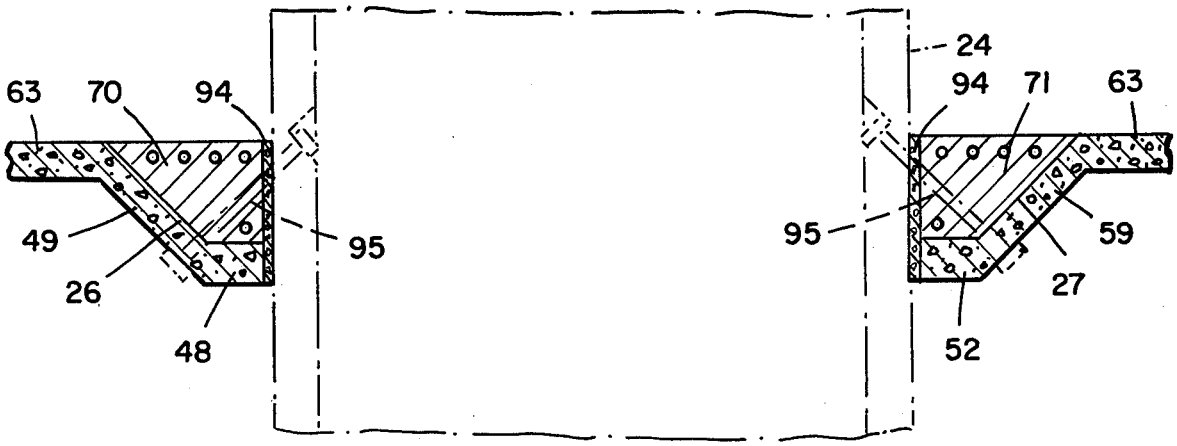

As discussed previously, poured-in-place concrete material such as 92, 93 fills the void remaining in transverse folds 26, 27 after the precast beams are in place, as depicted in FIG. 13. Such poured-in-place concrete material 92, 93 terminates at the core tower sidewall 24 depicted in FIG. 14. Grout material 94 is interposed between the precast 70, 71 and the inner edges of floor slab 63 and core tower 24. Floor slab 63 is attached to the core tower by tension bolts 95, and is partially supported in its elevated position by the friction between the floor slab and the tower.

In operation, according to the teachings of the preferred embodiment of the present invention, one or more core towers such as 24 are constructed to their intended vertical dimension. After the core towers have been fully constructed, a first floor slab such as 12 having a folded plate construction is poured in place at the base of the tower. The outline of the form for the first floor slab can be provided by excavating the ground surrounding the core tower to the desired shape. After the first floor slab has been poured and cured, it is coated or covered, and the next floor slab is poured in place using the first floor slab as a form. The desired number of floor slabs are constructed in this manner at the base of the tower.

After all the floor slabs have been poured and cured at the base of the tower, the free ends of the folded dowels in the uppermost floor slab are folded outwardly. Precast beams 70–73 are placed in folds 26–29, and reinforced concrete is poured in place in the remaining folds and in the depressed inner and outer borders so that the entire floor slab provides a continuous planar supporting surface. The uppermost floor slab containing these beam stiffeners is raised into its preselected elevated position and fastened to the core tower. Beam stiffeners are then added to the next uppermost floor slab, this floor slab is raised and fastened to the core tower, and the process is continued until the entire building structure has been completed.

The cast-in-place beams as placed in the upwardly concave folds have an additional and non-obvious advantage. It has been stressed that the floor slabs with upwardly concave fold plate construction without the beams in place possess structural integrity and rigidity. Often this integrity and rigidity will be sufficient to allow the slabs to be raised into place before the cast-in-place beams are fully cured and have attained their full structural rigidity and stiffness. For example, the reinforcing bars of the cast-in-place beams can be relied upon to carry tension almost immediately.

Thus, when the cast-in-place beams are poured and partially cured, hoisting of a floor into place and the fastening of the floor into place can occur. Thereafter, while the beams of the hoisted and fastened floor cure and come to full strength, the immediately underlying floor can be having its upward concave folds exposed. These exposed upwardly concave folds of an underlying floor can have cast-in-place beams placed while the beams of an overlying floor cure. Construction of a building is vastly accelerated.

While a preferred embodiment of the present of the present invention has been illustrated in detail, it is apparent that modifications and adaptations of the embodiment will occur to those skilled in the art. For example, the present invention is described as applied to a building having multiple floors formed at ground level and raised to preselected elevated positions, but it is apparent that the floor construction of the present invention could be applied to other building construction methods as well. It is to be expressly understood that such modifications and adaptations of the preferred embodiment are within the spirit and scope of the present invention, as set forth in the following claims.

We claim:

1. In a building having at least one vertical structural member supported on a foundation at its lower end and extending upwardly at least a partial height of a building at its upper end, a plurality of stacked floors at the base of said vertical structural member; and, means for raising and fastening said floors with said top floor of said stack being raised first to an upper supported elevation for support by said vertical structural member and said lower floor of said stack being raised second to a lower supported position by said vertical structural member, the improvement in said plurality of stacked floors comprising: a plurality of stacked floor slabs; each said floor slab including at least first and second poured and cured horizontal reinforced concrete slab sections of substantially the same vertical thickness for defining in side-by-side relation the major planar supporting surface of said floor; a fold of reinforced concrete of said same vertical thickness disposed along a path across each said floor between said first and second slab sections, said fold defining an upwardly exposed depression and rigidly joined at one upper extremity to said first slab portion and rigidly joined at its other upper extremity to said second slab portion to fasten said slab portions in side-by-side relation with the lowest point of said fold extending below the lower surface of said slabs and forming at least part of a first and lower beam flange disposed along said substantially linear path and said first and second slab portions as rigidly attached adjacent said fold forming at least part of a second and upper beam flange disposed along said linear path to support and stiffen each said floor, each said floor slab being nestable with an adjacent floor slab with its respective first and second slab sections and upwardly concave fold of reinforced concrete there betweeen immediately adjacent at a surface of said floor to corresponding and identical overlying undersurfaces of said stacked overlying floor slabs.

2. The invention of claim 1 and wherein each said floor slab at the periphery includes a downwardly disposed folded edge of reinforced concrete circumscribing at least a portion of the periphery of said floor; said downwardly disposed folded edge being of said same vertical thickness rigidly attached to the periphery of said floor to form at its lower extremity a first and lower flange of a peripheral floor supporting beam and to form adjacent its point of attachment to the periphery of said floor a second and upper flange of a floor stiffening and supporting beam; and, downwardly disposed folded edge having the same vertical thickness.

3. The invention of claim 2 and wherein said downwardly disposed folded edge of reinforced concrete is folded at an angle in the range of 30° to 60° with respect to said major supporting surface.

4. The invention of claim 1 and wherein said upwardly exposed depression of said fold of reinforced concrete comprises a V-section of concrete and wherein the two sections of the V are disposed at angles in the range of 30° to 60° with respect to said major supporting surface.

5. An improved floor slab for a reinforced concrete building comprising: at least first and second poured and cured horizontal reinforced concrete slab sections of predetermined vertical thickness for defining in side-by-side relation the major planar supporting surface of said floor; a fold of reinforced concrete disposed along a path crossing said floor between said first and second slab sections, said fold having said predetermined vertical thickness rigidly joined at one upper extremity to said first slab portion and rigidly joined at its other extremity to said second slab portion and defining an upwardly exposed depression between said slab portions to fasten said slab portions in side-by-side relation; the lower portion of said fold extending below the lower surface of said slab sections forming at least part of a first and lower beam flange disposed along said path and said first and second slab portions as rigidly attached adjacent said fold forming at least part of a second and upper beam flange disposed along said path to support and stiffen said floor and a floor stiffening beam is fastened in the upwardly exposed depression of the said fold to reinforce and stiffen said floor.

6. The invention of claim 5 and wherein the upper section of said floor stiffening beam as fastened to said upwardly exposed depression of said fold is coplanar to said major supporting surface of said floor to complete the major supporting surface of said floor across said fold.

7. The invention of claim 5 and wherein said beam is cast-in-place into the depression of said fold.

8. The invention of claim 5 and wherein said beam is precast and placed in the depression of said fold.

9. The invention of claim 5 and wherein said floor at the periphery includes a downwardly disposed folded edge of reinforced concrete of said predetermined vertical thickness circumscribing at least a portion of the periphery of the floor and extending below the lower surface of said concrete slab sections; said downwardly disposed folded edge being rigidly attached to the periphery of said floor to form at its lower extremity a first and lower flange of a peripheral floor supporting beam and to form adjacent its point of attachment to the periphery of said floor a second and upper flange of a floor stiffening and supporting beam and a peripheral beam fastened from above on top of said downwardly disposed folded edge to stiffen and support said floor.

10. The invention of claim 9 and wherein the upper flange of said peripheral beam completes the major planar supporting surface of said floor at the edge of said floor.

11. In a building having the steps of erecting a vertical structural member supported on a foundation at a lower end and extending upward at least a partial height of a building at its upper end; constructing a plurality of stacked floors at the base of said tower; and, sequentially raising and fastening said floors with said top floor of said stack being raised first to an upper supported elevation for support by said vertical structural member and said lower floors of said stack being raised second to a lower supported position by said vertical structural member, the improvement in the construction of said plurality of stacked floors at the base of said vertical structural member comprising: constructing at the base of said tower at least one floor slab; using the upper surface of said floor slab as the underlying surface of a form for the immediately overlying floor slab; forming in each of said floor slabs at least first and second poured and cured horizontal reinforced concrete slab sections of substantially the same vertical thickness for defining in side-by-side relation the major planar supporting surface of each said floor; forming between said slab portions of each said floor a fold of reinforced concrete of said same vertical thickness having an upwardly exposed depression disposed along a path between said first and second slab sections; rigidly joining said upwardly exposed depression of said fold on each floor at one upper extremity to said first slab portion and at the other upper extremity to said second slab portion to fasten said slab portions in side-by-side relation whereby the lowest point of said fold extends below the surface of said floor slabs and forms at least part of a first and lower beam flange disposed along said path and said first and second slab portions as rigidly attached adjacent said fold forming at least part of a second and upper beam flange disposed along said linear path to support and stiffen said floor.

12. The invention of claim 11 and including the step immediately before said sequentially raising and fastening of each said floor of placing in the upwardly exposed depression of said fold of said floor on the top of said stack only a floor reinforcing and stiffening beam.

13. The invention of claim 12 and wherein said placing step includes the step of placing a precast beam in said upwardly exposed depression fold of concrete.

14. The invention of claim 12 and including the step of forming in said upwardly exposed depression of said fold of each said floor reinforcing and stiffening beam a surface parallel to the major supporting surface of said floor slab, said beam being placed in said floor before said floor is raised.

15. The process of claim 12 and wherein said placing step includes the steps of pouring and at least partially curing a reinforced concrete beam in the upwardly exposed depression of said fold of said concrete floor slab.

16. The invention of claim 15 and wherein said placing step includes the step of pouring and completely curing a reinforced concrete beam in the upwardly exposed depression fold of said concrete floor slab.

17. The invention of claim 11 and including the step of forming in said upwardly exposed depression of said fold of each said floor, when said floor is at the top of said stack, a floor surface substantially coplanar with the major supporting surface of said floor slab.

18. In a building process having the steps of erecting a vertical structural member supported on a fundation at a lower end and extending upwardly at least a partial height of the building at its upper end; constructing at least one floor at the base of said member; and, raising the fastening said floor to said vertical structural member in its erected position, the improvement in the construction of said floor at the base of said vertical structural member comprising: forming at least first and second poured and cured horizontal reinforced concrete slab sections of substantially the same vertical thickness for defining in side-by-side relation the major planar supporting surface of said floor; forming between said slab portions of said floor a fold having said same vertical thickness with an upwardly exposed depression of reinforced concrete; rigidly joining said upwardly concave fold at one upper extremity to said first slab portion and at the other upper extremity to the second slab portion to fasten said slab portions in side-by-side relation; and, placing in the upwardly concave fold of said floor a floor reinforcing and stiffening beam before raising and fastening the floor to the vertical structural member.

19. The invention of claim 18 and wherein said placing step includes the step of placing a precast beam in said upwardly exposed depression of said fold of concrete.

20. The process of claim 18 and wherein said placing step includes the step of pouring at least partially curing a reinforced concrete beam in the upwardly disposed depression of said fold of said concrete floor slab.

21. The invention of claim 18 and including the step of forming in said upwardly exposed depression of said fold of said floor a floor surface substantially parallel to the major supporting surface of said floor slab.

22. In a building process having the steps of erecting a vertical structural member supported on a foundation at the lower end and extending upward at least a partial height of the building at its upper end; constructing a plurality of stacked floors at the base of said tower; and, sequentially raising and fastening said floors with said top floor of said stack being raised first to an upper supported elevation for support by said vertical structural member and said lower floors of said stack being raised subsequently to lower supported positions for support by said vertical structural member, the improvement in the construction of said plurality of stacked floors at the base of said vertical structural member comprising: constructing at the base of said tower a plurality of stacked floor slabs, each said floor slab including at least first and second poured and cured horizontal concrete floor slab sections of substantially the same vertical thickness for defining in side-by-side relation the major planar supporting surface of said floor; and forming between said slabs and across said floor a fold of reinforced concrete of said same vertical thickness defining an upwardly exposed depression disposed along a path between said first and second slab sections, said upwardly exposed depression of said fold rigidly joined at one upper extremity to said first slab portion and rigidly joined at its other upper extremity to said second slab portion to fasten said slab portions in side-by-side relation; and, sequentially placing in the upwardly concave fold of each said floor slab immediately after its overlying slab has been raised and fastened but before said slab is raised and fastened a floor reinforcing and stiffening beam.

23. The invention of claim 22 and wherein the placing of the beam includes the step of pouring and at least partially curing a cast-in-place beam at said upwardly exposed depression of said fold of said floor.

24. The invention of claim 22 and wherein the placing of said beam step includes placing a precast concrete beam in said upwardly exposed depression of said fold.

25. The invention of claim 22 and including the step of defining at the upper surface of said placed beam a surface parallel to the major planar supporting surface of said floor.

26. A process for constructing an improved floor slab for a reinforced concrete building, said process comprising the steps of: pouring and curing at least first and second horizontal reinforced concrete slab sections having a predetermined vertical thickness for defining in side-by-side relation the major planar supporting surface of said floor; pouring and curing a fold of reinforced concrete disposed along a path crossing said floor between said first and second slab sections, said fold having said predetermined vertical thickness; rigidly joining said fold at one upper extremity to said first slab portion, and rigidly joining said fold at its other upper extremity to said second slab portion to define an upwardly exposed depression between said slab portions to fasten said slab portions in side-by-side relation whereby the lower portion of said fold extends below the lower surface of said slab sections and forms at least a first and lower beam flange disposed along said path, and said first and second slab portions as rigidly attached adjacent said fold form at least a part of a second and upper beam flange disposed along said path to support and stiffen said floor and further including the step of fastening a floor stiffening beam in the upwardly exposed depression of said fold to reinforce and stiffen said floor.

27. The invention of claim 26 and wherein said fastening step includes casting into place a poured and cured concrete beam into the upwardly exposed depression of said fold.

28. The invention of claim 27 and including defining in said upwardly exposed depression of said fold of reinforced concrete a series of pockets; disposing in said pockets concrete reinforcing rods; and, before said pouring and curing step of said cast-in-place beams, bending the reinforced concrete outwardly from said pockets into the area to be occupied by said beam whereby said reinforcing bar cures to said beam and said pocket keys said beam.

* * * * *